US011268290B1

(12) United States Patent
Zolar

(10) Patent No.: US 11,268,290 B1
(45) Date of Patent: Mar. 8, 2022

(54) SYSTEM FOR ADJUSTING SURFACE LEVEL

(71) Applicant: AGOR Engineering Enterprises Ltd., Tel-Aviv (IL)

(72) Inventor: Yoash Zolar, Tel-Aviv (IL)

(73) Assignee: AGOR Engineering Enterprises Ltd., Tel-Aviv (IL)

( * ) Notice: Subject to any disclaimer, the term of this patent is extended or adjusted under 35 U.S.C. 154(b) by 0 days.

(21) Appl. No.: 17/139,523

(22) Filed: Dec. 31, 2020

(51) Int. Cl.
*E04H 4/06* (2006.01)

(52) U.S. Cl.
CPC ..... *E04H 4/065* (2013.01)

(58) Field of Classification Search
CPC ..... E04H 4/065
USPC ..... 4/495
See application file for complete search history.

(56) References Cited

U.S. PATENT DOCUMENTS 3,110,476 A * 11/1963 Farris ..... B66F 7/065 254/122
4,754,713 A * 7/1988 Chatenay epouse Compagnone ..... E04H 3/126 100/144
2014/0208500 A1* 7/2014 Yoash ..... E04H 4/065 4/495

* cited by examiner

*Primary Examiner* — Tuan N Nguyen
(74) *Attorney, Agent, or Firm* — Sughrue Mion, PLLC

(57) ABSTRACT

A system for adjusting surface level, comprising a moveable surface; a mechanism adapted to be disposed between and coupled to the moveable surface and a fixed surface; a force transfer mechanism configured to be coupled to the mechanism for displacement of the moveable surface relative to the fixed surface; and a plurality of stopping rods, disposed between the moveable surface and the fixed surface, which are operative for restricting an axial movement of the moveable surface relative to the fixed surface in a first mode of operation and for restricting a radial movement of the moveable surface relative to the fixed surface in a second mode of operation.

18 Claims, 5 Drawing Sheets

SYSTEM FOR ADJUSTING SURFACE LEVEL

Reference is made to U.S. patent application Ser. No. 14/061,794, filed Oct. 24, 2013 and entitled "SYSTEM FOR ADJUSTING SURFACE LEVEL", the disclosure of which is hereby incorporated by reference in its entirety.

FIELD OF THE INVENTION

The present invention relates to systems for adjusting surface level and more particularly to a mechanical system for adjusting floor level.

BACKGROUND OF THE INVENTION

Swimming pools create permanent danger for people, animals and objects around them, especially for babies, kids, people and animals that cannot swim. Hence movable floors were developed, so the swimming pool has one permanent base floor, and a movable floor thereabove, which may be raised so as to provide a solid cover for the swimming pool and adjust the swimming pool depth as desired by any given user: shallow for babies and kids, deep for adult users.

SUMMARY OF THE INVENTION

The present invention seeks to provide an improved system for adjusting surface level.

There is thus provided in accordance with an embodiment of the present invention a system for adjusting surface level, comprising a moveable surface; a mechanism adapted to be disposed between and coupled to the moveable surface and a fixed surface; a force transfer mechanism configured to be coupled to the mechanism for displacement of the moveable surface relative to the fixed surface; and a plurality of stopping rods, disposed between the moveable surface and the fixed surface, which are operative for restricting an axial movement of the moveable surface relative to the fixed surface in a first mode of operation and for restricting a radial movement of the moveable surface relative to the fixed surface in a second mode of operation.

Preferably, the mechanism comprises first and second structures supported between the fixed surface and the moveable surface and a connecting rod coupled between the first and second structures; and wherein upon actuation of the force transfer mechanism, the first and second structures are radially moveable in parallel to each other, thus causing the axial displacement of the moveable surface relative to the fixed surface, whereas the moveable surface is displaced in parallel to the fixed surface up to coupling of one side of the moveable surface with the fixed surface by at least one of the plurality of stopping rods; and wherein subsequently, the first and second structures are further radially moveable in parallel to each other, thus causing the radial displacement of the moveable surface relative to the fixed surface, whereas the moveable surface is displaced radially relative to the fixed surface up to coupling of another side of the moveable surface with the fixed surface by another one of the plurality of stopping rods.

Alternatively, the force transfer mechanism comprises at least two force transfer mechanisms, supported between the fixed surface and the moveable surface; and wherein upon actuation of the at least two force transfer mechanisms, the moveable surface is axially displaced relative to the fixed surface, whereas the moveable surface is displaced in parallel to the fixed surface up to coupling of one side of the moveable surface with the fixed surface by at least one of the plurality of stopping rods; and wherein subsequently, the moveable surface is radially displaced relative to the fixed surface, whereas the moveable surface is displaced radially relative to the fixed surface up to coupling of another side of the moveable surface with the fixed surface by another one of the plurality of stopping rods.

Further alternatively, the force transfer mechanism comprises a cable that is selectably released and tensioned by the force transfer mechanism; and wherein upon actuation of the force transfer mechanism, the moveable surface is axially displaced relative to the fixed surface, whereas the moveable surface is displaced in parallel to the fixed surface up to coupling of one side of the moveable surface with the fixed surface by at least one of the plurality of stopping rods; and wherein subsequently, the moveable surface is radially displaced relative to the fixed surface, whereas the moveable surface is displaced radially relative to the fixed surface up to coupling of another side of the moveable surface with the fixed surface by another one of the plurality of stopping rods.

Still further alternatively, the mechanism comprises first and second rods, which are supported between the fixed surface and the moveable surface and are hingedly attached to each other in a scissor-like manner; and wherein upon actuation of the force transfer mechanism, the moveable surface is axially displaced relative to the fixed surface, whereas the moveable surface is displaced in parallel to the fixed surface up to coupling of one side of the moveable surface with the fixed surface by at least one of the plurality of stopping rods; and wherein subsequently, the moveable surface is radially displaced relative to the fixed surface, whereas the moveable surface is displaced radially relative to the fixed surface up to coupling of another side of the moveable surface with the fixed surface by another one of the plurality of stopping rods.

Preferably, the plurality of stopping rods comprises a first stopping rod having a first length and a second stopping rod having a second length and wherein the first length is greater than the second length and wherein the first stopping rod is operative for restricting the axial movement and the second stopping rod is operative for restricting the radial movement.

Further preferably, the at least two structures are adapted for slidable movement relative to the movable surface. Still further preferably, each of the at least two structures are slidably coupled with the moveable surface and hingedly coupled with the fixed surface. Yet further preferably, the connecting rod is hingedly coupled to both of the first and second structures.

In accordance with an embodiment of the present invention, the force transfer mechanism is a hydraulic cylinder. Preferably, the moveable surface is adapted to fit an interior perimeter of a swimming pool. Further preferably, the force transfer mechanism is disposed within the swimming pool. Alternatively, the force transfer mechanism is disposed outside of the swimming pool.

Preferably, the force transfer mechanism is a single force transfer mechanism employed in order to displace both the first structure and the second structure using the connecting rod, which provides for force transfer between the first and second structures.

In accordance with an embodiment of the present invention, the plurality of stopping rods are fixedly coupled to the moveable surface. Preferably, transition between the first and second modes of operation results from engagement of at least one of the plurality of stopping rods with the fixed surface. Further preferably, the plurality of stopping rods are spaced apart from each other and extend in parallel to each other.

In accordance with an embodiment of the present invention, a method for adjusting surface level, comprising providing a moveable surface; providing a mechanism adapted to be disposed between and coupled to the moveable surface and a fixed surface; coupling a force transfer mechanism to the mechanism for displacement of the moveable surface relative to the fixed surface; providing a plurality of stopping rods, disposed between the moveable surface and the fixed surface; actuating the force transfer mechanism for axially moving the moveable surface relative to the fixed surface in a first mode of operation until restriction of the axial movement by at least one of the plurality of stopping rods and thereafter radially moving the moveable surface relative to the fixed surface in a second mode of operation until restriction of the radial movement by another one of the plurality of stopping rods, thereby adjusting surface level of the moveable surface relative to said the surface.

Preferably, the mechanism comprises first and second structures supported between the fixed surface and the moveable surface and a connecting rod coupled between the first and second structures. Further preferably, the plurality of stopping rods are fixedly coupled to the moveable surface.

BRIEF DESCRIPTION OF THE DRAWINGS

The present invention will be understood and appreciated more fully from the following detailed description, taken in conjunction with the drawings in which.

DESCRIPTION OF EMBODIMENTS

Mechanical systems for adjustment of a surface level are described. The surface may be the floor of a swimming pool, the cover of a swimming pool, or it may alternatively be any surface that can be vertically adjustable, such as for example a wall or a window.

According to one specific embodiment of the present invention the system for adjusting a surface level may be employed for changing the depth of a swimming pool floor, and for inclining the floor whenever desired.

In accordance with an embodiment of the present invention, the system includes means for sequential axial and radial displacement of a movable structure in a manner that provides a strong, stable and safe floor at any desired depth. The described system, in accordance with the embodiments of the present invention, is simple and inexpensive to construct and provides a stable floor with the ability to carry heavy loads, similar to regular or heavy constructed floors.

Further in accordance with an embodiment of the present invention, a plurality of stopping rods are provided between a fixed and a moveable surface disposed within a swimming pool. The moveable surface is adapted to be initially displaced axially in parallel to the fixed surface in order to provide a shallow depth throughout the entire surface of the swimming pool, thus enabling a safe environment for infants or people that can not swim. Upon reaching a certain depth, the moveable surface is then adapted to be gradually inclined, while moving radially with respect to the fixed surface due to the structure including the stopping rods disposed between the moveable and the fixed surfaces, as described in detail hereinbelow and exemplified using various embodiments.

It is noted that the structure described in the different embodiments of the present invention that includes a plurality of stopping rods disposed between the moveable and the fixed surfaces obviates the need in any electric or mechanical or electro-mechanical control mechanisms.

It is a particular feature of an embodiment of the present invention that the stopping rod can be attached to the moveable surface, to the fixed surface, to a portion of the height adjusting mechanism. Alternatively, at least one of the stopping rods may be attached to the moveable surface and at least one other stopping rod may be attached to the fixed surface.

Figure 1A:
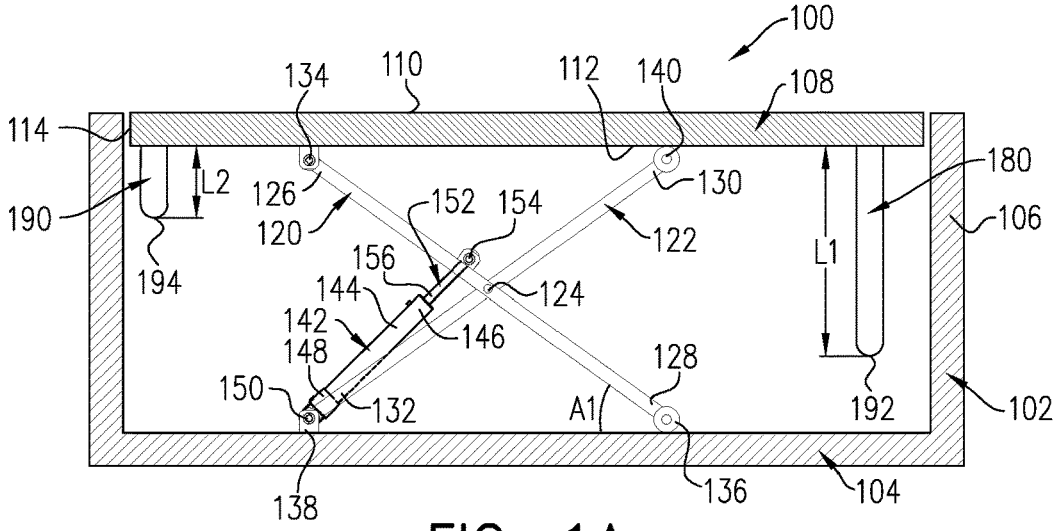
FIGS. 1A-1C are respective simplified sectional illustrations of a system for adjusting surface level in a raised position, a lowered position and in an inclined position respectively, constructed and operative in accordance with an embodiment of the present invention.
Figure 1B:
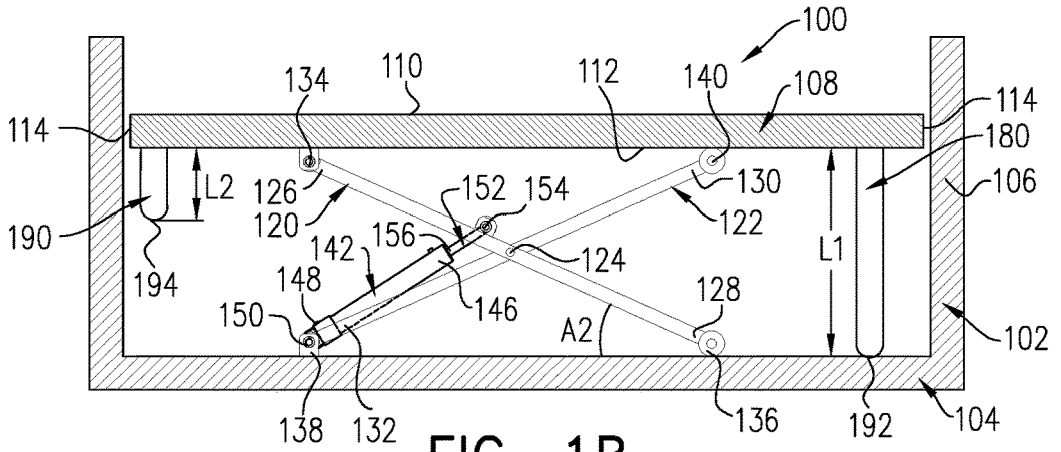
Figure 1C:
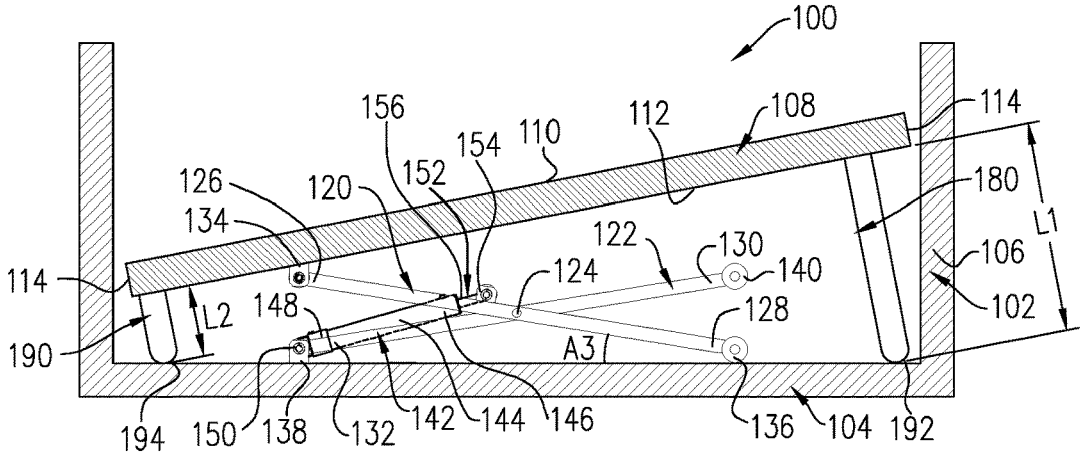

Reference is now made to FIGS. 1A-1C, which are respective simplified sectional illustrations of a system for adjusting surface level in a raised position, a lowered position and in an inclined position respectively, constructed and operative in accordance with an embodiment of the present invention.

A sectional illustration of a system for adjusting surface level 100 is shown in a swimming pool 102 in FIGS. 1A-1C.

The swimming pool 102 preferably has a bottom fixed surface 104 and side walls 106 transversely extending therefrom.

A moveable surface 108 is disposed within the swimming pool 102 and forms part of the system for adjusting surface level 100. The moveable surface 108 preferably has a shape that fits the inner perimeter formed by the side walls 106 of the swimming pool 102. The movable surface 108 has two opposite surfaces, an upwardly facing surface 110 and an opposite downwardly facing surface 112 facing the fixed surface 104. The movable surface 108 also defines side edges 114, which are adapted to be positioned adjacent the side walls 106 of the swimming pool 102.

It is noted that sliding elements may be provided on side edges 114 of the moveable surface 108, which are adapted to protect the side walls 106 of the swimming pool 102 during the displacement of moveable surface 108 thereal-ong.

The system for adjusting surface level 100 preferably includes a first rod 120 and a second rod 122, which are arranged generally in a scissor-shape with respect to each other, such that the two rods 120 and 122 are intersecting and are rotatably coupled to each other at a hinge 124, as seen particularly in FIGS. 1A-1C.

The first and second rods 120 and 122 are preferably disposed between the fixed surface 104 and the movable surface 108. The first rod 120 preferably has a first end 126 and an opposite second end 128. The second rod 122 preferably has a first end 130 and an opposite second end 132. A hinge 134 is preferably coupled between the first end 126 of the first rod 120 and the moveable surface 108 and a bearing 136 is preferably coupled to the second end 128 of the first rod 120. A hinge 138 is preferably coupled between the second end 132 of the second rod 122 and the fixed surface 104 and a bearing 140 is preferably coupled to the first end 130 of the second rod 122. It is seen in FIGS. 1A-1C that the first rod 120 slidably engages the fixed surface 104 and the second rod 122 slidably engages the moveable surface 108. It is noted that any suitable mechanism may be employed in order to achieve slidable engagement between the first end 130 of the second rod 122 and between the movable surface 108. Also, it is noted that any suitable mechanism may be employed in order to achieve slidable engagement between the second end 128 of the first rod 120 and between the fixed surface 104.

It is noted that this structure enables relative rotatable displacement between the two rods 120 and 122 about hinge 124 and in mutual opposite rotational directions. Due to the slidable engagement provided between the first rod 120 and the fixed surface 104 and the second rod 122 and the moveable surface 108, displacement of the moveable surface 108 relative to the fixed surface 104 is enabled.

It is further seen in FIGS. 1A-1C that a force transfer mechanism 142 is coupled to the first rod 120. It is appreciated that force transfer mechanism 142 may be alternatively coupled to the second rod 122. The force transfer mechanism 142 in this particular embodiment depicted in FIGS. 1A-1C is coupled to the fixed surface 104.

The force transfer mechanism 142 according to an embodiment of the present invention has a hydraulic cylinder, however it is appreciated that the invention is not limited to this possibility only and any available force transfer device can be interplaced in order to transfer force to the first rod 120 and thereby to the second rod 122, for example, electric plunger, electric transmission motor, hydraulic motor or any other actuator that enables displacement of the first and second rods 120 and 122.

The force transfer mechanism 142 typically has a hydraulic cylinder 144 having a first end 146 and a second end 148, wherein the second end 148 is adapted to be hingedly coupled to the fixed surface 104 by means of a supporting member 150. The hydraulic cylinder 144 is preferably slidably associated with a plunger rod 152, having a first end 154 and a second end 156. The second end 156 of the plunger rod 152 is slidably inserted into the first end 146 of the hydraulic cylinder 144 and the first end 154 of the plunger rod 152 is hingedly connected to the first rod 120.

It is a particular feature of an embodiment of the present invention that a first stopping rod 180 and a second stopping rod 190 are disposed between the fixed surface 104 and the moveable surface 108 and are selectably operative to restrict displacement of the moveable surface 108 relative to the fixed surface 104 either in an axial or in a radial direction. It is noted that any number of stopping rods may be provided between the fixed surface 104 and the moveable surface 108 in accordance with an embodiment of the present invention.

It is specifically seen that according to one embodiment of the present invention, first stopping rod 180 is fixedly coupled to the downwardly facing surface 112 of the moveable surface 108 and extends transversely and downwardly therefrom to a downward edge 192. The first stopping rod 180 preferably extends downwardly transversely with respect to the moveable surface 108 and has a length L1. The first stopping rod 180 according to one embodiment of the present invention is disposed between the bearing 140 and the side wall 106 of the swimming pool 102. Second stopping rod 190 is fixedly coupled to the downwardly facing surface 112 of the moveable surface 108 and extends transversely and downwardly therefrom to a downward edge 194. The second stopping rod 190 preferably extends downwardly transversely with respect to the moveable surface 108 and has a length L2, which is preferably substantially smaller than length L1. The second stopping rod 190 according to one embodiment of the present invention is disposed between the hinge 134 and the side wall 106 of the swimming pool 102.

It is noted that alternatively, the first and second stopping rods 180 and 190, or any other number of stopping rods, can be attached to the fixed surface 104 or to one or both of the first and second rods 120 and 122, as long as the stopping rods are operative for restricting the movement of the movable surface 108 relative to the fixed surface 104 in at least one of axial or radial directions, as is described hereinebelow.

The moveable surface 108 is disposed in its first operative orientation in FIG. 1A, which is the upward position of the moveable surface 108 relative to the fixed surface 104. It is seen that the first and second rods 120 and 122 are disposed at an angle A1 with respect to the fixed surface 104 in this first operative orientation. The moveable surface 108 is disposed in parallel to the fixed surface 104. It is also seen in FIG. 1A that in this first operative orientation, the downward edge 192 of the first stopping rod 180 is upwardly spaced from the fixed surface 104 and the downward edge 194 of the second stopping rod 190 is even more upwardly spaced from the fixed surface 104.

It is additionally seen in FIG. 1A that the force transfer mechanism 142 is disposed in an extended position in this first operative orientation, in which the distance between the first end 154 of the plunger rod 152 and the first end 146 of the hydraulic cylinder 144 is the longest.

In this first operative orientation, when the moveable surface 108 is in its raised position, the moveable surface 108 is adapted to be substantially in line with the upper surface of the swimming pool 102, securely covering the swimming pool 102.

Turning now specifically to FIG. 1B, the moveable surface 108 is disposed in its second operative orientation in FIG. 1B, which is the intermediate position of the moveable surface 108 relative to the fixed surface 104. It is seen in FIG. 1B that the force transfer mechanism 142 is actuated and is now disposed in a partially retracted position in this second operative orientation, in which the distance between the first end 154 of the plunger rod 152 and the first end 146 of the hydraulic cylinder 144 is smaller than the distance thereof in FIG. 1A.

Upon actuation of the force transfer mechanism 142, it is seen that the first and second rods 120 and 122 are now hingedly radially displaced with respect to each other about hinge 124. The first rod 120 slides along the fixed surface 104 and the second rod 122 slides along the moveable surface 108, such that the rods 120 and 122 are now disposed at angle A2 with respect to the fixed surface, whereas angle A2 is smaller than angle A1.

It is a particular feature of an embodiment of the present invention that the moveable surface 108 is displaced axially downwardly in parallel to the fixed surface 104 up to engagement of the downward edge 192 of the first stopping rod 180 with the fixed surface 104. In this second operative orientation, the downward edge 194 of the second stopping rod 190 is still upwardly spaced from the fixed surface 104, due to the fact that length L2 of the second stopping rod 190 is substantially shorter than the length L1 of the first stopping rod 180. Further axial downward displacement of the moveable surface 108 relative to the fixed surface 104 is restricted in this second operative orientation due to the first stopping rod 180 which is disposed between the moveable surface 108 and the fixed surface 104 and prevents further downward axial displacement of the moveable surface 108 in parallel to the fixed surface 104.

It is also seen in FIG. 1B that the first and second stopping rods 180 and 190 extend axially downwardly due to their fixed attachment to the moveable surface 108, which is now disposed in parallel with respect to the fixed surface 104.

It is noted that this second operative orientation of the movebale surface 108, as shown in FIG. 1B, is particularly operative for providing a shallow water swimming pool 102, which is safe for children or people that cannot swim.

Turning now specifically to FIG. 1C, the moveable surface 108 is disposed in its third operative orientation in FIG. 1C, which is the lowered inclined position of the moveable surface 108 relative to the fixed surface 104. It is seen in FIG. 1C that the force transfer mechanism 142 is further actuated and is now disposed in a retracted position in this third operative orientation, in which the distance between the first end 154 of the plunger rod 152 and the first end 146 of the hydraulic cylinder 144 is smaller than the distance thereof in FIG. 1B.

Upon further actuation of the force transfer mechanism 142, it is seen that the first and second rods 120 and 122 are further hingedly radially displaced with respect to each other and now extend at an angle A3 with respect to the fixed surface 104. Angle A3 is smaller than angle A2.

It is a particular feature of an embodiment of the present invention that upon further actuation of the force transfer mechanism 142, one of the rods, in this case the second rod 122 disengages from the movable surface 108 and the moveable surface 108 is radially displaced downwardly relative to the fixed surface 104 up to engagement of the downward edge 194 of the second stopping rod 190 with the fixed surface 104. In this third operative orientation, the downward edges 192 and 194 of the stopping rods 180 and 190 respectively engage the fixed surface 104. Further radial displacement of the moveable surface 108 relative to the fixed surface 104 is restricted in this third operative orientation due to the second stopping rod 190 which is disposed between the moveable surface 108 and the fixed surface 104 and prevents further radial displacement of the moveable surface 108 relative to the fixed surface 104. It is particularly seen in FIG. 1C that the moveable surface 108 is disposed in an inclined position in this third operative orientation, in which the movable surface 108 is disposed at an angle relative to the fixed surface 104.

In this inclined position, one of the ends of the moveable surface 108 is disposed at a larger distance from the fixed surface 104 as compared to the other end of the moveable surface 108, thus assuming a lowered position of the moveable surface 108. In the lowered position, the moveable surface 108 is adapted to be lower than the upper surface of the swimming pool 102, acting as the floor of the swimming pool 102.

It is seen in FIG. 1C that the first and second stopping rods 180 and 190 are disposed at an angle relative to the fixed surface 104 due to their fixed attachment to the moveable surface 108, which is now inclined relative to the fixed surface 104.

It is a particular feature of an embodiment of the present invention that the length of the first stopping rod 180 defines the depth of beginning of the radial displacement of the moveable surface 108 and the length of the second stopping rod 190 defines the depth of the incline, which is the deep end of the swimming pool 102.

It is seen that in this third operative orientation of the moveable surface 108 shown in FIG. 1C, the bearing 140 of the second rod 122 is disengaged from the moveable surface 108 and the hinge 134 of the first rod 120 is fixedly attached to the downwardly facing surface 112 of the moveable surface 108.

It is a particular feature of an embodiment of the present invention that first and second rods 120 and 122 are supported between the fixed surface 104 and the moveable surface 108 and are hingedly attached to each other in a scissor-like manner. The force transfer mechanism 142 is adapted for selectably applying force to one of the first and second rods 120 and 122. Upon actuation of the force transfer mechanism 142, the first and second rods 120 and 122 are radially moveable relative to each other about the hinge disposed at an intersection point between the rods 120 and 122, thus causing displacement of the moveable surface 108 relative to the fixed surface 104, due to the attachment of the first and second rods 120 and 122 relative to the moveable surface 108. One side of each one of the rods 120 and 122 is hingedly coupled to the moveable surface 108 and slidably coupled to the fixed surface 104. In a first mode of operation, the moveable surface 108 is displaced in parallel to the fixed surface 104 up to coupling of one side of the moveable surface 108 with the fixed surface 104 by means of the long stopping rod 180, upon such coupling, further axial displacement of the moveable surface 108 relative to the fixed surface 104 is prevented. In a second mode of operation, one of the rods 120 and 122, in this particular embodiment shown as the second rod 122, disengages the moveable surface 108 and the moveable surface 108 is radially displaced relative to the fixed surface 104 up to coupling of the other side of the moveable surface 108 with the fixed surface 104 by means of the short stopping rod 190, upon such coupling, further radial displacement of the moveable surface 108 relative to the fixed surface 104 is prevented.

It will be appreciated by persons skilled in the art that any other mechanism operative for displacing the movable surface, such as 108, relative to the fixed surface, such as 104, and having several stopping rods of different lengths which are disposed between the moveable surface and the fixed surface, whereas the stopping rods are adapted to restrict axial displacement of the moveable surface relative the fixed surface and radial displacement of the moveable surface relative to the fixed surface in different operative orientations of the system, is considered to be within the scope of the embodiments of the present invention.

Figure 2A:
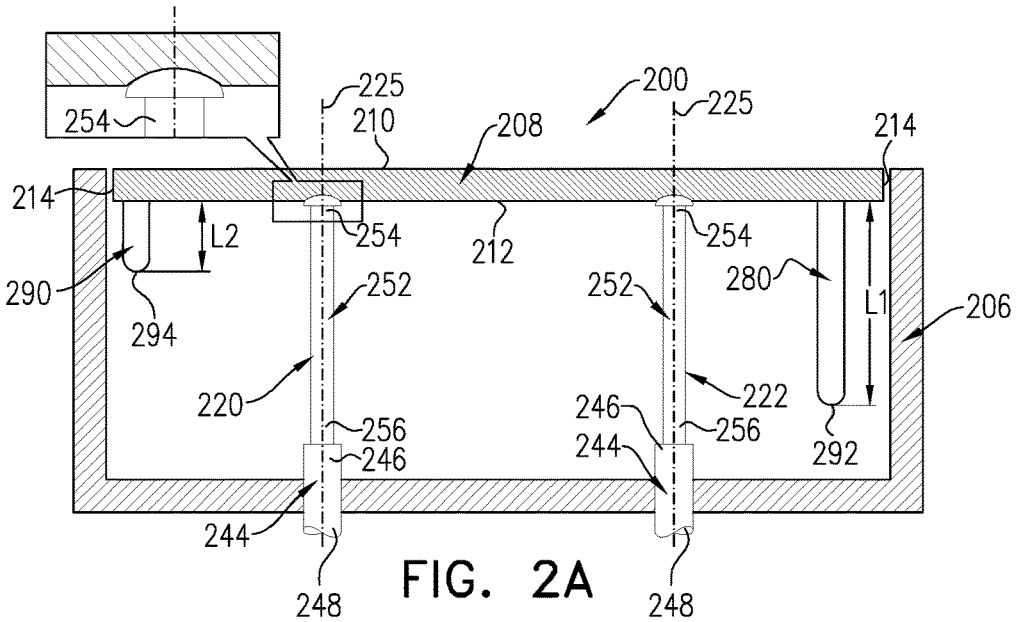
FIGS. 2A-2C are respective simplified sectional illustrations of a system for adjusting surface level in a raised position, a lowered position and in an inclined position respectively, constructed and operative in accordance with another embodiment of the present invention.
Figure 2B:
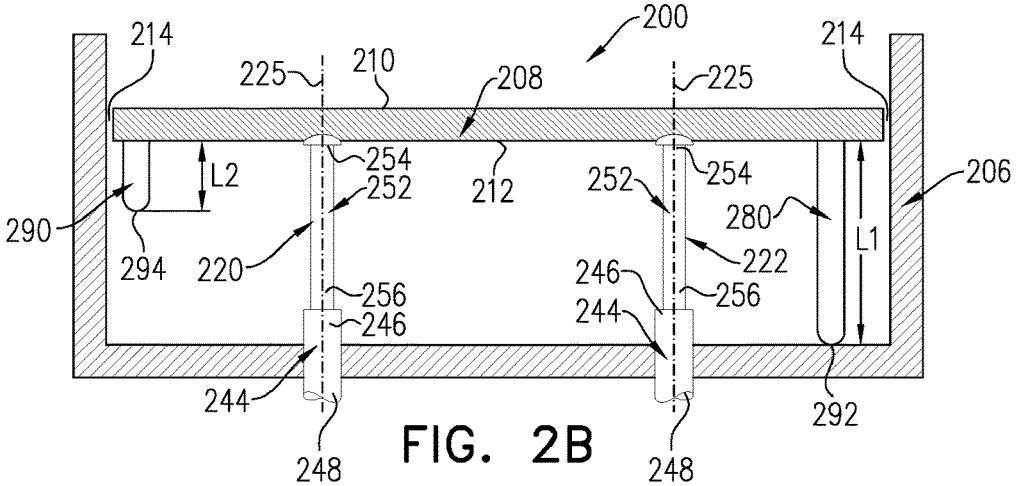
Figure 2C:
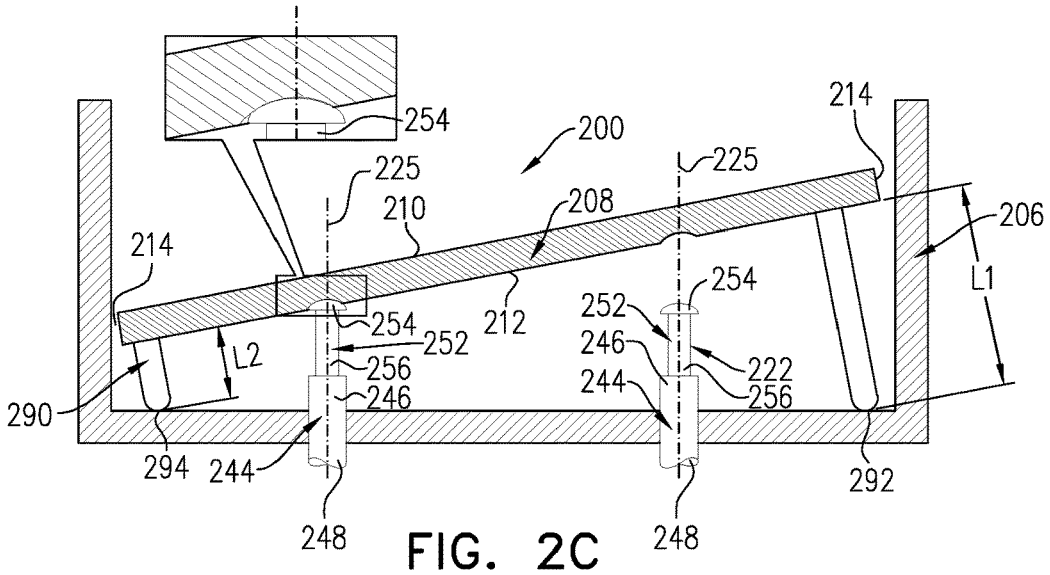

Reference is now made to FIGS. 2A-2C, which are respective simplified sectional illustrations of a system for adjusting surface level in a raised position, a lowered position and in an inclined position respectively, constructed and operative in accordance with another embodiment of the present invention.

A sectional illustration of a system for adjusting surface level 200 is shown in a swimming pool 202 in FIGS. 2A-2C.

The swimming pool 202 preferably has a bottom fixed surface 204 and side walls 206 transversely extending therefrom.

A moveable surface 208 is disposed within the swimming pool 202 and forms part of the system for adjusting surface level 200. The moveable surface 208 preferably has a shape that fits the inner perimeter formed by the side walls 206 of the swimming pool 202. The movable surface 208 has two opposite surfaces, an upwardly facing surface 210 and an opposite downwardly facing surface 212 facing the fixed surface 204. The movable surface 208 also defines side edges 214, which are adapted to be positioned adjacent the side walls 206 of the swimming pool 102.

It is noted that sliding elements may be provided on side edges 214 of the moveable surface 208, which are adapted to protect the side walls 206 of the swimming pool 202 during the displacement of moveable surface 208 thereal-ong.

The system for adjusting surface level 200 preferably includes a first force transfer mechanism 220 and a second force transfer mechanism 222, which are disposed generally in parallel with respect to each other, as seen in FIGS. 2A-2C and are preferably spaced apart from each other and arranged along longitudinal axes 225.

The first and second force transfer mechanisms 220 and 222 are preferably disposed between the fixed surface 204 and the movable surface 208. The first and second force transfer mechanisms 220 and 222 are preferably similar in all respects, thus one of the mechanisms will be further described and similar reference numerals will be designated for similar parts of the two mechanisms 220 and 222.

The force transfer mechanism 220 according to an embodiment of the present invention has a hydraulic cylinder, however it is appreciated that the invention is not limited to this possibility only and any available force transfer device can be interplaced in order to exert force to the moveable surface 208. For example, electric plunger, electric transmission motor, hydraulic motor or any other actuator that enables displacement of the moveable surface 208.

The force transfer mechanism 220 typically has a hydraulic cylinder 244 having a first end 246 and a second end 248, wherein the second end 248 is adapted to be fixedly coupled to the fixed surface 204. The hydraulic cylinder 244 is preferably slidably associated with a plunger rod 252, having a first end 254 and a second end 256. The second end 256 of the plunger rod 252 is slidably inserted into the first end 246 of the hydraulic cylinder 244 and the first end 254 of the plunger rod 252 engages the moveable surface 108.

It is noted that in accordance with an embodiment of the present invention, two force transfer mechanisms 220 and 222 are provided, however any other number of force transfer mechanisms can be employed in accordance with an embodiment of the present invention.

It is a particular feature of an embodiment of the present invention that a first stopping rod 280 and a second stopping rod 290 are disposed between the fixed surface 204 and the moveable surface 208 and are selectably operative to restrict displacement of the moveable surface 208 relative to the fixed surface 204 either in an axial or in a radial direction. It is noted that any number of stopping rods may be provided between the fixed surface 204 and the moveable surface 208 in accordance with an embodiment of the present invention.

It is specifically seen that according to one embodiment of the present invention, first stopping rod 280 is fixedly coupled to the downwardly facing surface 212 of the moveable surface 208 and extends transversely and downwardly therefrom to a downward edge 292. The first stopping rod 280 preferably extends along a longitudinal axis, which is parallel to longitudinal axis 225 and has a length L1. The first stopping rod 280 according to one embodiment of the present invention is disposed between the second force transfer mechanism 222 and the side wall 206 of the swimming pool 202. Second stopping rod 290 is fixedly coupled to the downwardly facing surface 212 of the moveable surface 208 and extends transversely and downwardly therefrom to a downward edge 294. The second stopping rod 290 preferably extends along a longitudinal axis, which is parallel to longitudinal axis 225 and has a length L2, which is preferably substantially smaller than length L1. The second stopping rod 290 according to one embodiment of the present invention is disposed between the first force transfer mechanism 220 and the side wall 206 of the swimming pool 202.

It is noted that alternatively, the first and second stopping rods 280 and 290, or any other number of stopping rods, can be attached to the fixed surface, as long as the stopping rods are operative for restricting the movement of the movable surface 208 relative to the fixed surface 204 in at least one of axial or radial directions, as is described hereinebelow.

The moveable surface 208 is disposed in its first operative orientation in FIG. 2A, which is the upward position of the moveable surface 208 relative to the fixed surface 204. It is seen that the first and second force transfer mechanisms 220 and 222 are disposed generally transversely with respect to the moveable surface 208 in this first operative orientation, the moveable surface 208 is disposed in parallel to the fixed surface 204. It is also seen in FIG. 2A that in this first operative orientation, the downward edge 292 of the first stopping rod 280 is upwardly spaced from the fixed surface 204 and the downward edge 294 of the second stopping rod 290 is even more upwardly spaced from the fixed surface 204.

It is additionally seen in FIG. 2A that both the first and the second force transfer mechanisms 220 and 222 are disposed in an extended position in this first operative orientation, in which the distance between the first end 254 of the plunger rod 252 and the first end 246 of the hydraulic cylinder 244 is the longest.

In this first operative orientation, when the moveable surface 208 is in its raised position, the moveable surface 208 is adapted to be substantially in line with the upper surface of the swimming pool 202, securely covering the swimming pool 202.

Turning now specifically to FIG. 2B, the moveable surface 208 is disposed in its second operative orientation, which is the intermediate position of the moveable surface 208 relative to the fixed surface 204. It is seen in FIG. 2B that both of the force transfer mechanisms 220 and 222 are actuated and are now disposed in a partially retracted position in this second operative orientation, in which the distance between the first end 254 of the plunger rod 252 and the first end 246 of the hydraulic cylinder 244 is smaller than the distance thereof in FIG. 2A.

Upon simultaneous actuation of the force transfer mechanisms 220 and 222, the plunger rods 252 partially retract into the hydraulic cylinders 244 and the moveable surface 208 is consequently axially lowered towards the fixed surface 204.

It is a particular feature of an embodiment of the present invention that the moveable surface 208 is displaced axially downwardly in parallel to the fixed surface 204 up to engagement of the downward edge 292 of the first stopping rod 280 with the fixed surface 204. In this second operative orientation, the downward edge 294 of the second stopping rod 290 is still upwardly spaced from the fixed surface 204, due to the fact that length L2 of the second stopping rod 290 is substantially shorter than the length L1 of the first stopping rod 280. Further axial displacement along longitudinal axis 225 of the moveable surface 208 relative to the fixed surface 204 is restricted in this second operative orientation due to the first stopping rod 280 which is disposed between the moveable surface 208 and the fixed surface 204 and prevents further downward axial displacement of the moveable surface 208 in parallel to the fixed surface 204.

It is also seen in FIG. 2B that the first and second stopping rods 280 and 290 extend in parallel to longitudinal axis 225 due to their fixed attachment to the moveable surface 208, which is now disposed in parallel with respect to the fixed surface 204.

It is noted that this second operative orientation of the movebale surface 208, as shown in FIG. 2B, is particularly operative for providing a shallow water swimming pool 202, which is safe for children or people that cannot swim.

Turning now specifically to FIG. 2C, the moveable surface 208 is disposed in its third operative orientation in FIG. 2C, which is the lowered inclined position of the moveable surface 208 relative to the fixed surface 204. It is seen in FIG. 2C that the first and second force transfer mechanisms 220 and 222 are further actuated and are now disposed in a retracted position in this third operative orientation, in which the distance between the first end 254 of the plunger rod 252 and the first end 246 of the hydraulic cylinder 244 is smaller than the distance thereof in FIG. 2B.

It is a particular feature of an embodiment of the present invention that upon further actuation of the force transfer mechanisms 220 and 222, one of the force transfer mechanisms, in this case the second force transfer mechanism 222 disengages from the movable surface 208 and the moveable surface 208 is radially displaced downwardly relative to the fixed surface 204 up to engagement of the downward edge 294 of the second stopping rod 290 with the fixed surface 204. In this third operative orientation, the downward edges 292 and 294 of the stopping rods 280 and 290 respectively engage the fixed surface 204. Further radial displacement of the moveable surface 208 relative to the fixed surface 204 is restricted in this third operative orientation due to the second stopping rod 290 which is disposed between the moveable surface 208 and the fixed surface 204 and prevents further radial displacement of the moveable surface 208 relative to the fixed surface 204. It is particularly seen in FIG. 2C that the moveable surface 208 is disposed in an inclined position in this third operative orientation, in which the movable surface 208 is disposed at an angle relative to the fixed surface 204.

In this inclined position, one of the ends of the moveable surface 208 is disposed at a larger distance from the fixed surface 204 as compared to the other end of the moveable surface 208, thus assuming a lowered position of the moveable surface 208. In the lowered position, the moveable surface 208 is adapted to be lower than the upper surface of the swimming pool 202, acting as the floor of the swimming pool 202.

It is seen in FIG. 2C that the first and second stopping rods 280 and 290 are disposed at an angle relative to longitudinal axis 225 due to their fixed attachment to the moveable surface 208, which is now inclined relative to the fixed surface 204.

It is a particular feature of an embodiment of the present invention that the length of the first stopping rod 280 defines the depth of beginning of the radial displacement of the moveable surface 208 and the length of the second stopping rod 290 defines the depth of the incline, which is the deep end of the swimming pool 202.

It is seen that in this third operative orientation of the moveable surface 208 shown in FIG. 2C, the first end 254 of the plunger rod 252 of the second force transfer mechanism 222 is disengaged from the moveable surface 208 and the first end 254 of the plunger rod 252 of the first force transfer mechanism 220 is further engaged with the downwardly facing surface 212 of the moveable surface 208.

It is a particular feature of an embodiment of the present invention that first and second force transfer mechanisms 220 and 222 are supported between the fixed surface 204 and the moveable surface 208. The force transfer mechanisms 220 and 222 are adapted for selectably applying force to the moveable surface 208. Upon actuation of the force transfer mechanisms 220 and 222, the moveable surface 208 is displaced relative to the fixed surface 204. In a first mode of operation, the moveable surface 208 is displaced in parallel to the fixed surface 204 up to coupling of one side of the moveable surface 208 with the fixed surface 204 by means of a long stopping rod 280, upon such coupling, further axial displacement of the moveable surface 208 relative to the fixed surface 204 is prevented. In a second mode of operation, one of the force transfer mechanisms 220 and 222 disengages the moveable surface 208 and the moveable surface 208 is radially displaced relative to the fixed surface 204 up to coupling of the other side of the moveable surface 208 with the fixed surface 204 by means of a short stopping rod 290, upon such coupling, further radial displacement of the moveable surface 208 relative to the fixed surface 204 is prevented.

Figure 3A:
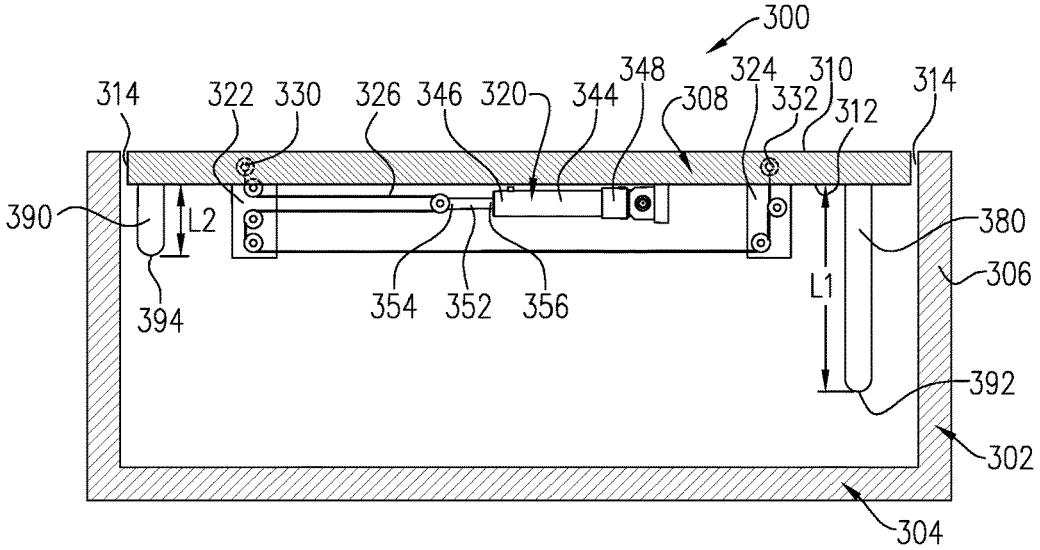
FIGS. 3A-3C are respective simplified sectional illustrations of a system for adjusting surface level in a raised position, a lowered position and in an inclined position respectively, constructed and operative in accordance with a further embodiment of the present invention.
Figure 3B:
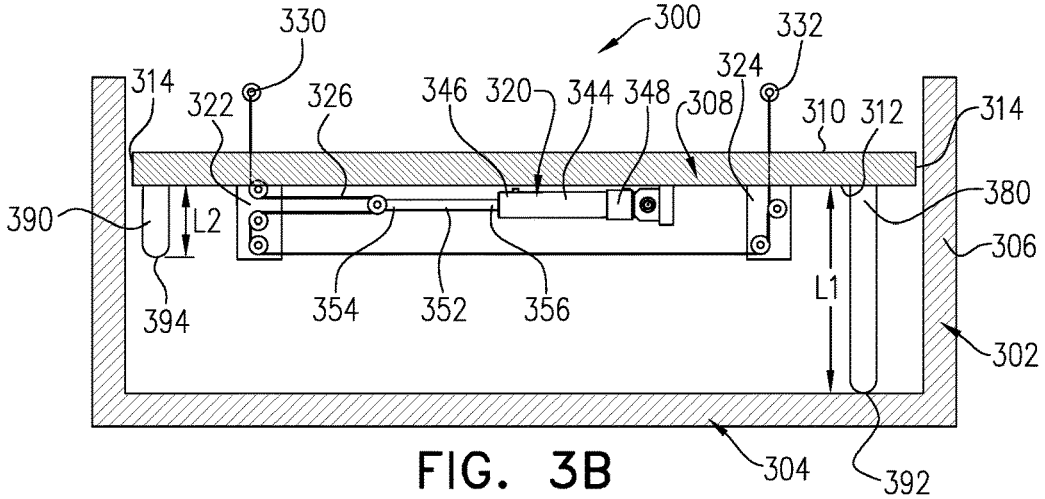
Figure 3C:
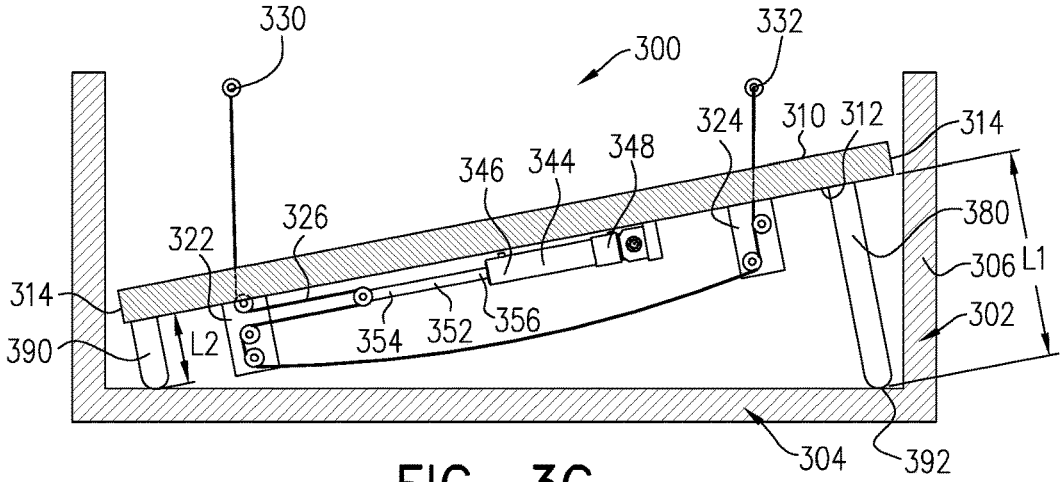

Reference is now made to FIGS. 3A-3C, which are respective simplified sectional illustrations of a system for adjusting surface level in a raised position, a lowered position and in an inclined position respectively, constructed and operative in accordance with a further embodiment of the present invention.

A sectional illustration of a system for adjusting surface level 300 is shown in a swimming pool 302 in FIGS. 3A-3C.

The swimming pool 302 preferably has a bottom fixed surface 304 and side walls 306 transversely extending therefrom.

A moveable surface 308 is disposed within the swimming pool 302 and forms part of the system for adjusting surface level 300. The moveable surface 308 preferably has a shape that fits the inner perimeter formed by the side walls 306 of the swimming pool 302. The movable surface 308 has two opposite surfaces, an upwardly facing surface 310 and an opposite downwardly facing surface 312 facing the fixed surface 304. The movable surface 308 also defines side edges 314, which are adapted to be positioned adjacent the side walls 306 of the swimming pool 302.

It is noted that sliding elements may be provided on side edges 314 of the moveable surface 308, which are adapted to protect the side walls 306 of the swimming pool 302 during the displacement of moveable surface 308 thereal-ong.

The system for adjusting surface level 300 preferably includes a force transfer mechanism 320 and typically, a first and a second pulley 322 and 324 operatively coupled with the force transfer mechanism 320 by means of cable 326. One side of the cable 326 is attached to a first anchor 330 at the side wall 306 of the swimming pool 302, disposed adjacent the first pulley 322. Another side of the cable 326 is attached to a second anchor 332 at the side wall 306 of the swimming pool 302, disposed adjacent the second pulley 324. The pulleys 322 and 324 are disposed generally in parallel with respect to each other, as seen in FIGS. 3A-3C and are preferably spaced apart from each other and fixedly attached to the downwardly facing surface 312 of the moveable surface 308.

The force transfer mechanism 320 is preferably attached to the downwardly facing surface 312 of the moveable surface 308. The force transfer mechanism 320 according to an embodiment of the present invention has a hydraulic cylinder, however it is appreciated that the invention is not limited to this possibility only and any available force transfer device can be interplaced in order to exert force to the moveable surface 308. For example, electric plunger, electric transmission motor, hydraulic motor or any other actuator that enables displacement of the moveable surface 308.

The force transfer mechanism 320 typically has a hydraulic cylinder 344 having a first end 346 and a second end 348. The hydraulic cylinder 344 is preferably slidably associated with a plunger rod 352, having a first end 354 and a second end 356. The second end 356 of the plunger rod 352 is slidably inserted into the first end 346 of the hydraulic cylinder 344 and the first end 354 of the plunger rod 352 retains a portion of the cable 326.

It is a particular feature of an embodiment of the present invention that a first stopping rod 380 and a second stopping rod 390 are disposed between the fixed surface 304 and the moveable surface 308 and are selectably operative to restrict displacement of the moveable surface 308 relative to the fixed surface 304 either in an axial or in a radial direction. It is noted that any number of stopping rods may be provided between the fixed surface 304 and the moveable surface 308 in accordance with an embodiment of the present invention.

It is specifically seen that according to one embodiment of the present invention, first stopping rod 380 is fixedly coupled to the downwardly facing surface 312 of the moveable surface 308 and extends transversely and downwardly therefrom to a downward edge 392. The first stopping rod 380 preferably extends along a longitudinal axis, which extends generally transversely relative to the moveable surface 308 and has a length L1. The first stopping rod 380 according to one embodiment of the present invention is disposed between the second pulley 324 and the side wall 306 of the swimming pool 302. Second stopping rod 390 is fixedly coupled to the downwardly facing surface 312 of the moveable surface 308 and extends transversely and downwardly therefrom to a downward edge 394. The second stopping rod 390 preferably extends along a longitudinal axis, which extends generally transversely relative to the moveable surface 308, and has a length L2, which is preferably substantially smaller than length L1. The second stopping rod 390 according to one embodiment of the present invention is disposed between the first pulley 322 and the side wall 306 of the swimming pool 302.

It is noted that alternatively, the first and second stopping rods 380 and 390, or any other number of stopping rods, can be attached to the fixed surface 304, as long as the stopping rods are operative for restricting the movement of the movable surface 308 relative to the fixed surface 304 in at least one of axial or radial directions, as is described hereinebelow.

The moveable surface 308 is disposed in its first operative orientation in FIG. 3A, which is the upward position of the moveable surface 308 relative to the fixed surface 304. The moveable surface 308 is disposed in parallel to the fixed surface 304 in this first operative orientation. It is also seen in FIG. 3A that in this first operative orientation, the downward edge 392 of the first stopping rod 380 is upwardly spaced from the fixed surface 304 and the downward edge 394 of the second stopping rod 390 is even more upwardly spaced from the fixed surface 304.

It is additionally seen in FIG. 3A that the force transfer mechanism 320 is disposed in a retracted position in this first operative orientation, in which the distance between the first end 354 of the plunger rod 352 and the first end 346 of the hydraulic cylinder 344 is the shortest.

In this first operative orientation, when the moveable surface 308 is in its raised position, the moveable surface 308 is adapted to be substantially in line with the upper surface of the swimming pool 302, securely covering the swimming pool 302.

Turning now specifically to FIG. 3B, the moveable surface 308 is disposed in its second operative orientation, which is the intermediate position of the moveable surface 308 relative to the fixed surface 304. It is seen in FIG. 3B that the force transfer mechanism 320 is actuated and is now disposed in a partially extended position in this second operative orientation, in which the distance between the first end 354 of the plunger rod 352 and the first end 346 of the hydraulic cylinder 344 is larger than the distance thereof in FIG. 3A.

Upon actuation of the force transfer mechanism 320, the plunger rod 352 partially extends out of the hydraulic cylinder 344, thereby partially releasing the cable 326 and consequently causing the lowering of the moveable surface 308 axially towards the fixed surface 304.

It is a particular feature of an embodiment of the present invention that the moveable surface 308 is displaced axially downwardly in parallel to the fixed surface 304 up to engagement of the downward edge 392 of the first stopping rod 380 with the fixed surface 304. In this second operative orientation, the downward edge 394 of the second stopping rod 390 is still upwardly spaced from the fixed surface 304, due to the fact that length L2 of the second stopping rod 390 is substantially shorter than the length L1 of the first stopping rod 380. Further axial displacement downwards of the moveable surface 308 relative to the fixed surface 304 is restricted in this second operative orientation due to the first stopping rod 380 which is disposed between the moveable surface 308 and the fixed surface 304 and prevents further downward axial displacement of the moveable surface 308 in parallel to the fixed surface 304.

It is also seen in FIG. 3B that the first and second stopping rods 380 and 390 extend in parallel to longitudinal axis due to their fixed attachment to the moveable surface 308, which is now disposed in parallel with respect to the fixed surface 304.

It is noted that this second operative orientation of the movebale surface 308, as shown in FIG. 3B, is particularly operative for providing a shallow water swimming pool 302, which is safe for children or people that cannot swim.

Turning now specifically to FIG. 3C, the moveable surface 308 is disposed in its third operative orientation in FIG. 3C, which is the lowered inclined position of the moveable surface 308 relative to the fixed surface 304. It is seen in FIG. 3C that the force transfer mechanism 320 is further actuated and is now disposed in an extended position in this third operative orientation, in which the distance between the first end 354 of the plunger rod 352 and the first end 346 of the hydraulic cylinder 344 is larger than the distance thereof in FIG. 3B.

It is a particular feature of an embodiment of the present invention that upon further actuation of the force transfer mechanism 320, the cable 326 is further released and the moveable surface 308 is radially displaced downwardly relative to the fixed surface 304 up to engagement of the downward edge 394 of the second stopping rod 390 with the fixed surface 304. In this third operative orientation, the downward edges 392 and 394 of the stopping rods 380 and 390 respectively engage the fixed surface 304. Further radial displacement of the moveable surface 308 relative to the fixed surface 304 is restricted in this third operative orientation due to the second stopping rod 390 which is disposed between the moveable surface 308 and the fixed surface 304 and prevents further radial displacement of the moveable surface 308 relative to the fixed surface 304. It is particularly seen in FIG. 3C that the moveable surface 308 is disposed in an inclined position in this third operative orientation, in which the movable surface 308 is disposed at an angle relative to the fixed surface 304.

In this inclined position, one of the ends of the moveable surface 308 is disposed at a larger distance from the fixed surface 304 as compared to the other end of the moveable surface 308, thus assuming a lowered position of the moveable surface 308. In the lowered position, the moveable surface 308 is adapted to be lower than the upper surface of the swimming pool 302, acting as the floor of the swimming pool 302.

It is seen in FIG. 3C that the first and second stopping rods 380 and 390 are disposed at an angle relative to longitudinal due to their fixed attachment to the moveable surface 308, which is now inclined relative to the fixed surface 304.

It is a particular feature of an embodiment of the present invention that the length of the first stopping rod 380 defines the depth of beginning of the radial displacement of the moveable surface 308 and the length of the second stopping rod 390 defines the depth of the incline, which is the deep end of the swimming pool 302.

It is a particular feature of an embodiment of the present invention that the force transfer mechanism 320 is coupled to the moveable surface 308. The force transfer mechanism 320 is adapted for selectably releasing or tensioning the cable 326, which in turn causes displacement of the moveable surface 308 through attachment thereof to pullies 322 and 324. Upon actuation of the force transfer mechanism 320, the moveable surface 308 is displaced relative to the fixed surface 304. In a first mode of operation, the moveable surface 308 is displaced in parallel to the fixed surface 304 up to coupling of one side of the moveable surface 308 with the fixed surface 304 by means of a long stopping rod 380, upon such coupling, further axial displacement of the moveable surface 308 relative to the fixed surface 304 is prevented. In a second mode of operation, the moveable surface 308 is radially displaced relative to the fixed surface 304 up to coupling of the other side of the moveable surface 308 with the fixed surface 304 by means of a short stopping rod 390, upon such coupling, further radial displacement of the moveable surface 308 relative to the fixed surface 304 is prevented.

Figure 4A:
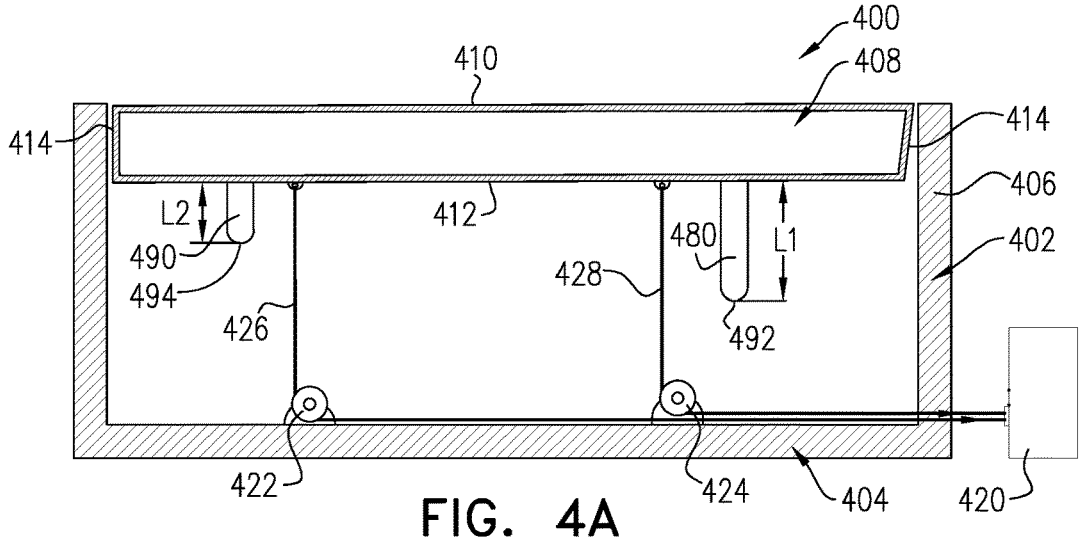
FIGS. 4A-4C are respective simplified sectional illustrations of a system for adjusting surface level in a raised position, a lowered position and in an inclined position respectively, constructed and operative in accordance with a still further embodiment of the present invention.
Figure 4B:
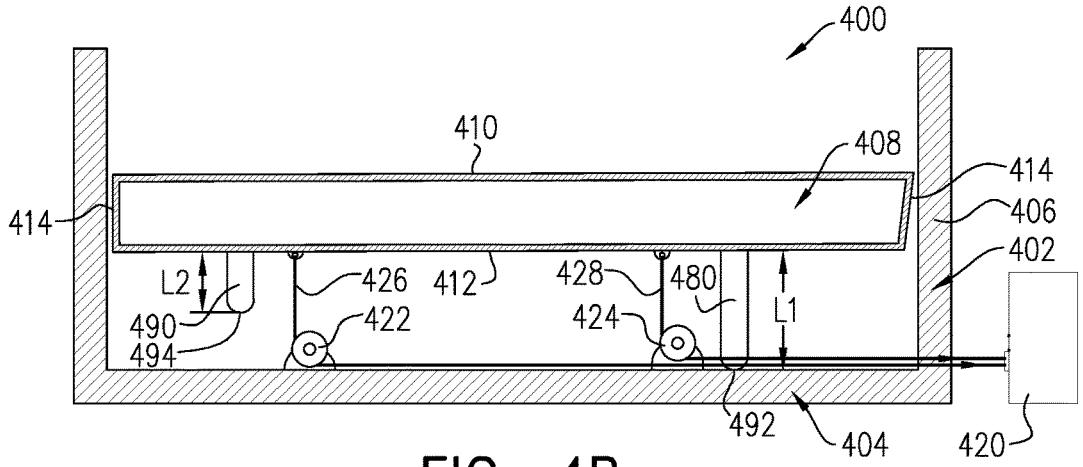
Figure 4C:
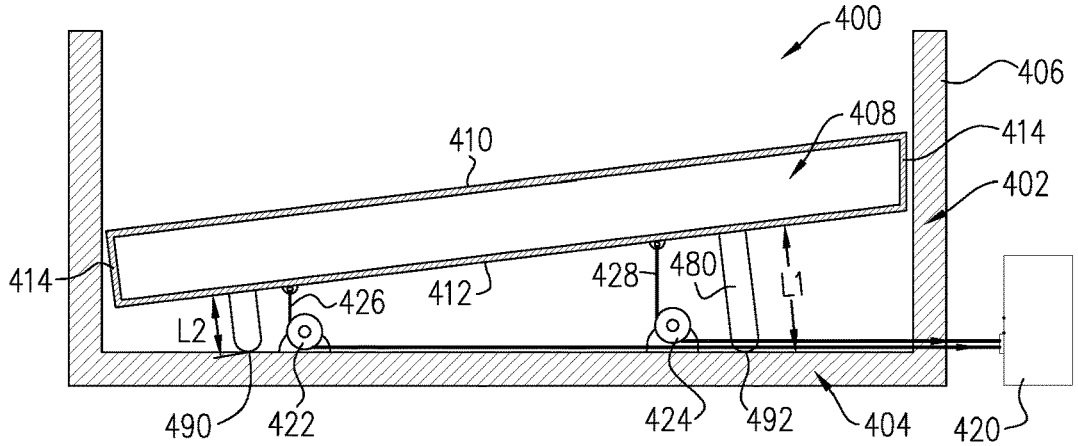

Reference is now made to FIGS. 4A-4C, which are respective simplified sectional illustrations of a system for adjusting surface level in a raised position, a lowered position and in an inclined position respectively, constructed and operative in accordance with a still further embodiment of the present invention.

A sectional illustration of a system for adjusting surface level 400 is shown in a swimming pool 402 in FIGS. 4A-4C.

The swimming pool 402 preferably has a bottom fixed surface 404 and side walls 406 transversely extending therefrom.

A moveable surface 408 is disposed within the swimming pool 402 and forms part of the system for adjusting surface level 400. The moveable surface 408 preferably has a shape that fits the inner perimeter formed by the side walls 406 of the swimming pool 402. The movable surface 408 has two opposite surfaces, an upwardly facing surface 410 and an opposite downwardly facing surface 412 facing the fixed surface 404. The movable surface 408 also defines side edges 414, which are adapted to be slidably coupled to the side walls 406 of the swimming pool 402. It is noted that the moveable surface 408 is filled with air, thus it is buoyant and is biased to be displaced upwardly.

It is noted that sliding elements may be provided on side edges 414 of the moveable surface 408, which are adapted to protect the side walls 406 of the swimming pool 402 during the displacement of moveable surface 408 therealong.

The system for adjusting surface level 400 preferably includes a force transfer mechanism 420 and typically, a first and a second pulley 422 and 424, each being operatively coupled with the force transfer mechanism 420 by means of cable 426 and 428 respectively. One side of the cable 426 is attached to the moveable surface 408 and another side of the cable 426 is attached to the force transfer mechanism 420 through the first pulley 422, which is attached to the fixed surface 404. One side of the cable 428 is attached to the moveable surface 408 and another side of the cable 428 is attached to the force transfer mechanism 420 through the second pulley 424, which is attached to the fixed surface 404. As seen in FIGS. 4A-4C the first and second pullies 422 and 424 are preferably spaced apart from each other and fixedly attached to the fixed surface 404.

The force transfer mechanism 420 in accordance with this embodiment is disposed outside of the swimming pool 402. Any available force transfer device can be utilized in order to pull cables 426 and 428 and thereby cause displacement of the moveable surface 408 relative to the fixed surface 404.

It is a particular feature of an embodiment of the present invention that a first stopping rod 480 and a second stopping rod 490 are disposed between the fixed surface 404 and the moveable surface 408 and are selectably operative to restrict displacement of the moveable surface 408 relative to the fixed surface 404 either in an axial or in a radial direction. It is noted that any number of stopping rods may be provided between the fixed surface 404 and the moveable surface 408 in accordance with an embodiment of the present invention and they may be attached either to the moveable surface 408 or to the fixed surface 404.

It is specifically seen that according to one embodiment of the present invention, first stopping rod 480 is fixedly coupled to the downwardly facing surface 412 of the moveable surface 408 and extends transversely and downwardly therefrom to a downward edge 492. The first stopping rod 480 preferably extends along a longitudinal axis, which extends generally transversely relative to the moveable surface 408 and has a length L1. The first stopping rod 480 according to one embodiment of the present invention is disposed between the second pulley 424 and the side wall 406 of the swimming pool 402. Second stopping rod 490 is fixedly coupled to the downwardly facing surface 412 of the moveable surface 408 and extends transversely and downwardly therefrom to a downward edge 494. The second stopping rod 490 preferably extends along a longitudinal axis, which extends generally transversely relative to the moveable surface 408, and has a length L2, which is preferably substantially smaller than length L1. The second stopping rod 490 according to one embodiment of the present invention is disposed between the first pulley 422 and the side wall 406 of the swimming pool 402.

It is noted that alternatively, the first and second stopping rods 480 and 490, or any other number of stopping rods, can be attached to the fixed surface 404, as long as the stopping rods are operative for restricting the movement of the movable surface 408 relative to the fixed surface 404 in at least one of axial or radial directions, as is described hereinebelow.

The moveable surface 408 is disposed in its first operative orientation in FIG. 4A, which is the upward position of the moveable surface 408 relative to the fixed surface 404. The moveable surface 408 is disposed in parallel to the fixed surface 404 in this first operative orientation. It is also seen in FIG. 4A that in this first operative orientation, the downward edge 492 of the first stopping rod 480 is upwardly spaced from the fixed surface 404 and the downward edge 494 of the second stopping rod 490 is even more upwardly spaced from the fixed surface 404.

In this first operative orientation, when the moveable surface 408 is in its raised position, the moveable surface 408 is retained substantially in line with the upper surface of the swimming pool 402, securely covering the swimming pool 402 due to the fact that the moveable surface 408 is filled with air and is buoyant.

Turning now specifically to FIG. 4B, the moveable surface 408 is disposed in its second operative orientation, which is the intermediate position of the moveable surface 408 relative to the fixed surface 404. It is seen in FIG. 4B that the force transfer mechanism 420 is actuated and now starts pulling the cables 426 and 428 and consequently causing the lowering of the moveable surface 408 axially towards the fixed surface 404 against the buoyancy force applied thereon.

It is a particular feature of an embodiment of the present invention that the moveable surface 408 is displaced axially downwardly in parallel to the fixed surface 404 up to engagement of the downward edge 492 of the first stopping rod 480 with the fixed surface 404. In this second operative orientation, the downward edge 494 of the second stopping rod 490 is still upwardly spaced from the fixed surface 404, due to the fact that length L2 of the second stopping rod 490 is substantially shorter than the length L1 of the first stopping rod 480. Further axial displacement downwards of the moveable surface 408 relative to the fixed surface 404 is restricted in this second operative orientation due to the first stopping rod 480 which is disposed between the moveable surface 408 and the fixed surface 404 and prevents further downward axial displacement of the moveable surface 408 in parallel to the fixed surface 404.

It is also seen in FIG. 4B that the first and second stopping rods 480 and 490 extend in parallel to longitudinal axis due to their fixed attachment to the moveable surface 408, which is now disposed in parallel with respect to the fixed surface 404.

It is noted that this second operative orientation of the movable surface 408, as shown in FIG. 4B, is particularly operative for providing a shallow water swimming pool 402, which is safe for children or people that cannot swim.

Turning now specifically to FIG. 4C, the moveable surface 408 is disposed in its third operative orientation in FIG. 4C, which is the lowered inclined position of the moveable surface 408 relative to the fixed surface 404. It is seen in FIG. 4C that the force transfer mechanism 420 is further actuated to further pull the cables 426 and 428 and thereby radially displace the moveable surface 408 relative to the fixed surface 404.

It is a particular feature of an embodiment of the present invention that upon further actuation of the force transfer mechanism 420, the cables 426 and 428 are further tensioned and the moveable surface 408 is radially displaced downwardly relative to the fixed surface 404 up to engagement of the downward edge 494 of the second stopping rod 490 with the fixed surface 404. In this third operative orientation, the downward edges 492 and 494 of the stopping rods 480 and 490 respectively engage the fixed surface 404. Further radial displacement of the moveable surface 408 relative to the fixed surface 404 is restricted in this third operative orientation due to the second stopping rod 490 which is disposed between the moveable surface 408 and the fixed surface 404 and prevents further radial displacement of the moveable surface 408 relative to the fixed surface 404. It is particularly seen in FIG. 4C that the moveable surface 408 is disposed in an inclined position in this third operative orientation, in which the movable surface 408 is disposed at an angle relative to the fixed surface 404.

In this inclined position, one of the ends of the moveable surface 408 is disposed at a larger distance from the fixed surface 404 as compared to the other end of the moveable surface 408, thus assuming a lowered position of the moveable surface 408. In the lowered position, the moveable surface 408 is adapted to be lower than the upper surface of the swimming pool 402, acting as the floor of the swimming pool 402.

It is seen in FIG. 4C that the first and second stopping rods 480 and 490 are disposed at an angle relative to longitudinal due to their fixed attachment to the moveable surface 408, which is now inclined relative to the fixed surface 404.

It is a particular feature of an embodiment of the present invention that the length of the first stopping rod 480 defines the depth of beginning of the radial displacement of the moveable surface 408 and the length of the second stopping rod 490 defines the depth of the incline, which is the deep end of the swimming pool 402.

It is a particular feature of an embodiment of the present invention that the force transfer mechanism 420 is coupled to the moveable surface 408 through cables 426 and 428. The force transfer mechanism 420 is adapted for selectably releasing or tensioning the cables 426 and 428, which in turn causes displacement of the moveable surface 408 through attachment thereof through cables 426, 428 and pullies 422 and 424. Upon actuation of the force transfer mechanism 420, the moveable surface 408 is displaced relative to the fixed surface 404. In a first mode of operation, the moveable surface 408 is displaced in parallel to the fixed surface 404 up to coupling of one side of the moveable surface 408 with the fixed surface 404 by means of a long stopping rod 480, upon such coupling, further axial displacement of the moveable surface 408 relative to the fixed surface 404 is prevented. In a second mode of operation, the moveable surface 408 is radially displaced relative to the fixed surface 404 up to coupling of the other side of the moveable surface 408 with the fixed surface 404 by means of a short stopping rod 490, upon such coupling, further radial displacement of the moveable surface 408 relative to the fixed surface 404 is prevented.

Figure 5A:
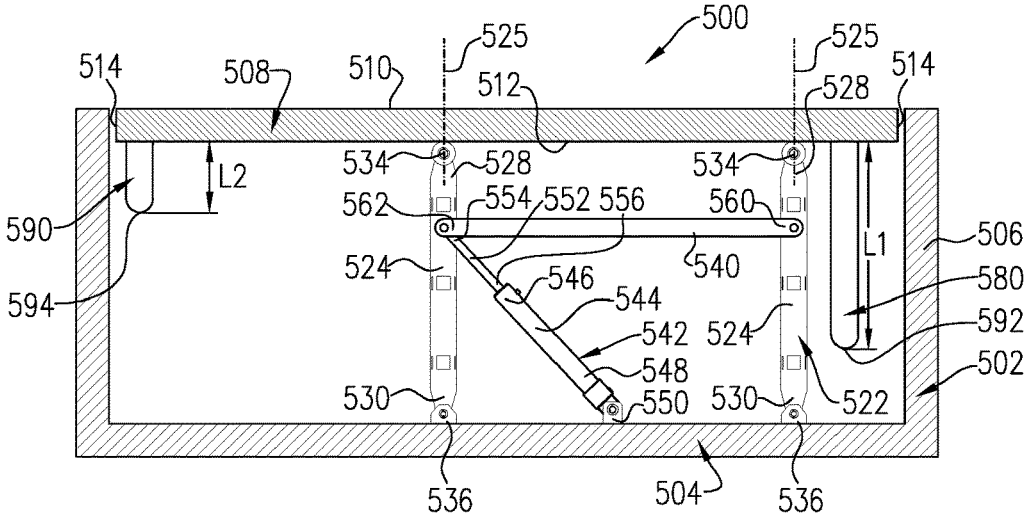
FIGS. 5A-5C are respective simplified sectional illustrations of a system for adjusting surface level in a raised position, a lowered position and in an inclined position respectively, constructed and operative in accordance with a yet further embodiment of the present invention.
Figure 5B:
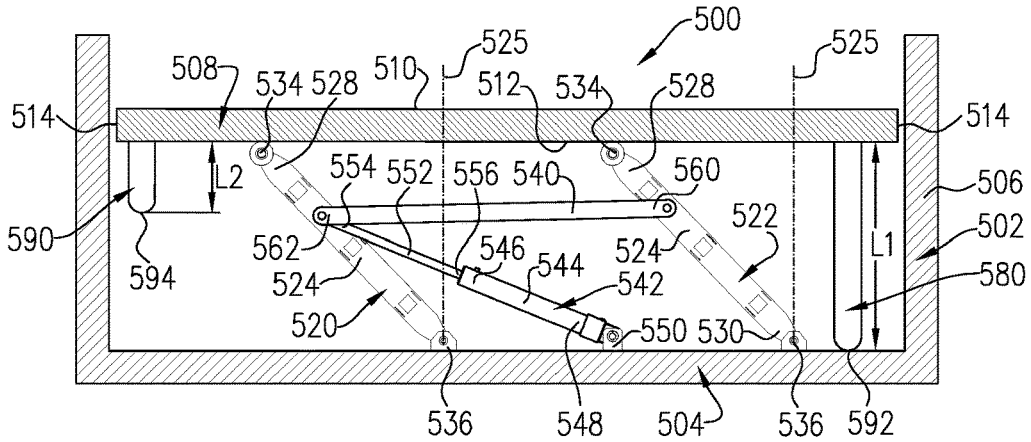
Figure 5C:
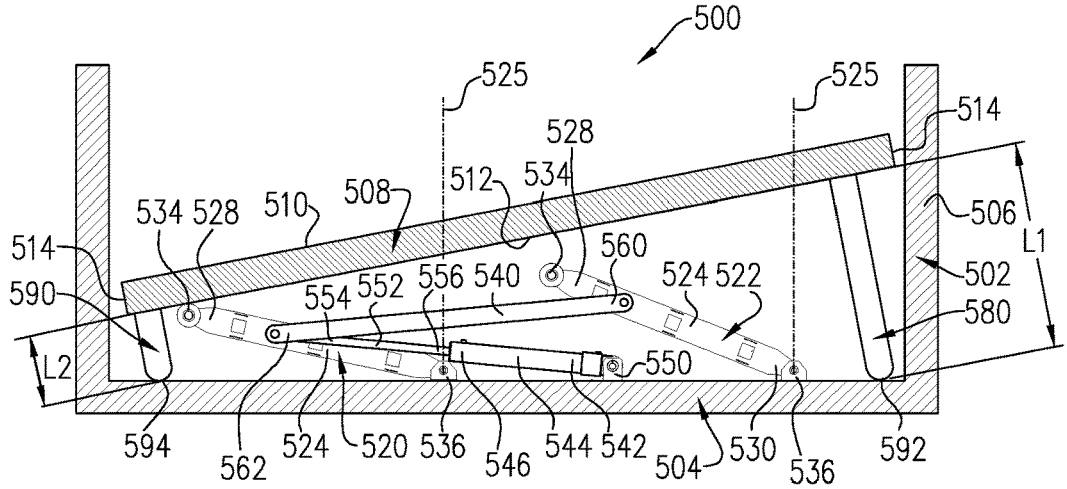

Reference is now made to FIGS. 5A-5C, which are respective simplified sectional illustrations of a system for adjusting surface level in a raised position, a lowered position and in an inclined position respectively, constructed and operative in accordance with a yet further embodiment of the present invention.

A sectional illustration of a system for adjusting surface level 500 is shown in a swimming pool 502 in FIGS. 5A-5C.

The swimming pool 502 preferably has a bottom fixed surface 504 and side walls 506 transversely extending therefrom.

A moveable surface 508 is disposed within the swimming pool 502 and forms part of the system for adjusting surface level 500. The moveable surface 508 preferably has a shape that fits the inner perimeter formed by the side walls 506 of the swimming pool 502. The movable surface 508 has two opposite surfaces, an upwardly facing surface 510 and an opposite downwardly facing surface 512 facing the fixed surface 504. The movable surface 508 also defines side edges 514, which are adapted to be positioned adjacent the side walls 506 of the swimming pool 502.

It is noted that sliding elements may be provided on side edges 514 of the moveable surface 508, which are adapted to protect the side walls 506 of the swimming pool 502 during the displacement of moveable surface 508 thereal-ong.

The system for adjusting surface level 500 preferably includes a first structure 520 and a second structure 522, which are disposed generally in parallel with respect to each other, as seen particularly in FIG. 5A and are preferably spaced apart from each other.

The first and second structures 520 and 522 are preferably disposed between the fixed surface 504 and the movable surface 508. The first structure 520 and the second structure 522 are preferably similar in all respects, thus one of the structures will be further described and similar reference numerals will be designated for similar parts of the two structures 520 and 522.

The first structure 520 preferably has at least one elongated rod 524, arranged along longitudinal axis 525. Alternatively, the first structure 520 may include several elongated rods 524 spaced from each other and connected by a connecting rod or a truss. The elongated rod 524 preferably has a first end 528 and an opposite second end 530. A bearing 534 is preferably coupled to the first end 528 of the elongated rod 524. A hinge 536 is preferably coupled to the second end 530 of the elongated rod 524. It is seen in FIGS. 5A-5C that the elongated rod 524 slidably engages the downwardly facing surface 512 of the movable surface 508. It is noted that any suitable mechanism may be employed in order to achieve slidable engagement between the first end 528 of the elongated rod 524 and between the movable surface 508.

As also seen in FIGS. 5A-5C, the second end 530 of the elongated rod 524 is preferably hingedly connected to the fixed surface 504 through hinge 536. The hinge 536 is preferably arranged about axis 537, which is disposed generally transversely with respect to longitudinal axis 525, thus enabling rotational displacement of the elongated rod 524 relative to the fixed surface 504.

It is seen in FIG. 5A that the first structure 520 is disposed in parallel to the second structure 522 and preferably a connecting rod 540 connects therebetween. The connecting rod 540 preferably extends transversely with respect to the first and the second structures 520 and 522 and is fixedly hingedly attached to each one of the structures 520 and 522.

It is further seen in FIGS. 5A-5C that a force transfer mechanism 542 is coupled to the first structure 520. It is appreciated that force transfer mechanism 542 may be alternatively coupled to the second structure 522. The force transfer mechanism 542 in this particular embodiment depicted in FIGS. 5A-5C is coupled to the elongated rod 524.

The force transfer mechanism 542 according to an embodiment of the present invention has a hydraulic cylinder, however it is appreciated that the invention is not limited to this possibility only and any available force transfer device can be interplaced in order to transfer force to the first structure 520 and to the second structure 522, for example, electric plunger, electric transmission motor, hydraulic motor or any other actuator that enables displacement of the first and second structures 520 and 522.

The force transfer mechanism 542 typically has a hydraulic cylinder 544 having a first end 546 and a second end 548, wherein the second end 548 is adapted to be hingedly coupled to the fixed surface 504 by means of a supporting member 550. The hydraulic cylinder 544 is preferably slidably associated with a plunger rod 552, having a first end 554 and a second end 556. The second end 556 of the plunger rod 552 is slidably inserted into the first end 546 of the hydraulic cylinder 544 and the first end 554 of the plunger rod 552 is hingedly connected to the elongated rod 524 of the first structure 520.

It is appreciated that the force transfer mechanism 542 may be disposed within the swimming pool 502, as depicted in the embodiment of the present invention shown in FIGS. 5A-5C and may be alternatively disposed in a separate compartment outside the swimming pool in order to avoid exposure of the force transfer mechanism to water, prevent corrosion and allow for using oils as well as water as the hydraulic fluid.

In case that the force transfer mechanism is disposed in a separate compartment, the coupling between it and between the second structure 522 can be achieved through a rod extending through a wall formed between the compartments.

It is a particular feature of an embodiment of the present invention that a single force transfer mechanism 542 is employed in order to displace both the first structure 520 and the second structure 522 together, in parallel to each other. This is achieved due to the connecting rod 540, which connects the first structure 520 and the second structure 522 and provides for force transfer from the first structure 520 to the second structure 522.

The connecting rod 540 has two opposite ends, a first end 560 is preferably hingedly connected to the second structure 522 and the second end 562 is preferably hingedly connected to the first structure 520. Thus, the connecting rod 540 is adapted to be rotatable relative to the first and the second structures 520 and 522 upon application of force onto at least one of the first and second structures 520 and 522.

It is a particular feature of an embodiment of the present invention that a first stopping rod 580 and a second stopping rod 590 are disposed between the fixed surface 504 and the moveable surface 508 and are selectably operative to restrict displacement of the moveable surface 508 relative to the fixed surface 504 either in an axial or in a radial direction. It is noted that any number of stopping rods may be provided between the fixed surface 504 and the moveable surface 508 in accordance with an embodiment of the present invention.

It is specifically seen that according to one embodiment of the present invention, first stopping rod 580 is fixedly coupled to the downwardly facing surface 512 of the moveable surface 508 and extends transversely and downwardly therefrom to a downward edge 592. The first stopping rod 580 preferably extends along a longitudinal axis, which is parallel to longitudinal axis 525 and has a length L1. The first stopping rod 580 according to one embodiment of the present invention is disposed between the second structure 522 and the side wall 506 of the swimming pool 502. Second stopping rod 590 is fixedly coupled to the downwardly facing surface 512 of the moveable surface 508 and extends transversely and downwardly therefrom to a downward edge 594. The second stopping rod 590 preferably extends along a longitudinal axis, which is parallel to longitudinal axis 525 and has a length L2, which is preferably substantially smaller than length L1. The second stopping rod 590 according to one embodiment of the present invention is disposed between the first structure 520 and the side wall 506 of the swimming pool 502.

It is noted that alternatively, the first and second stopping rods 580 and 590, or any other number of stopping rods, can be attached to the fixed surface 504 or to one or both of structures 520 or 522 or to the connecting rod 540, as long as the stopping rods are operative for restricting the movement of the movable surface 508 relative to the fixed surface 504 in at least one of axial or radial directions, as is described hereinebelow.

The moveable surface 508 is disposed in its first operative orientation in FIG. 5A, which is the upward position of the moveable surface 508 relative to the fixed surface 504. It is seen that the first and second structures 520 and 522 are disposed generally transversely with respect to the moveable surface 508 in this first operative orientation, the moveable surface 508 is disposed in parallel to the fixed surface 504. It is also seen in FIG. 5A that in this first operative orientation, the downward edge 592 of the first stopping rod 580 is upwardly spaced from the fixed surface 504 and the downward edge 594 of the second stopping rod 590 is even more upwardly spaced from the fixed surface 504.

It is additionally seen in FIG. 5A that the force transfer mechanism 542 is disposed in a retracted position in this first operative orientation, in which the distance between the first end 554 of the plunger rod 552 and the first end 546 of the hydraulic cylinder 544 is the shortest.

In this first operative orientation, when the moveable surface 508 is in its raised position, the moveable surface 508 is adapted to be substantially in line with the upper surface of the swimming pool 502, securely covering the swimming pool 502. In this raised position of the system 500, the elongated rods 524 of the first structure 520 and of the second structure 522 are preferably locked in place due to the force of the force transfer mechanism 542 exerted on the first structure 520.

Turning now specifically to FIG. 5B, the moveable surface 508 is disposed in its second operative orientation in FIG. 5B, which is the intermediate position of the moveable surface 508 relative to the fixed surface 504. It is seen in FIG. 5B that the force transfer mechanism 542 is actuated and is now disposed in a partially extended position in this second operative orientation, in which the distance between the first end 554 of the plunger rod 552 and the first end 546 of the hydraulic cylinder 544 is larger than the distance thereof in FIG. 5A.

Upon actuation of the force transfer mechanism 542, it is seen that the first and second structures 520 and 522 are now hingedly radially displaced with respect to the fixed surface 504 and now extend at an angle with respect to longitudinal axis 525. The first and second structures 520 and 522 are moveable in parallel to each other due to the connecting rod 540 which is fixedly attached between the two structures 520 and 522.

It is a particular feature of an embodiment of the present invention that the moveable surface 508 is displaced axially downwardly in parallel to the fixed surface 504 up to engagement of the downward edge 592 of the first stopping rod 580 with the fixed surface 504. In this second operative orientation, the downward edge 594 of the second stopping rod 590 is still upwardly spaced from the fixed surface 504, due to the fact that length L2 of the second stopping rod 590 is substantially shorter than the length L1 of the first stopping rod 580. Further axial displacement along longitudinal axis 525 of the moveable surface 508 relative to the fixed surface 504 is restricted in this second operative orientation due to the first stopping rod 580 which is disposed between the moveable surface 508 and the fixed surface 504 and prevents further downward axial displacement of the moveable surface 508 in parallel to the fixed surface 504.

It is seen that in this second operative orientation of the moveable surface 508 shown in FIG. 5B, that the first structure 520 and the second structure 522 are pivoting about the axis 537 of hinge 536, thereby causing slidable displacement of the bearings 534 along the downwardly facing surface 512 of the moveable surface 508. The first structure 520 is connected with the second structure 522 by means of the connecting rod 540. The extension of the plunger rod 552 and the hinged connection of the first and second ends 560 and 562 of the connection rod 540 with the first and second structures 520 and 522 respectively allow for corresponding movement of the first structure 520 along with and in parallel to the second structure 522.

It is also seen in FIG. 5B that the first and second stopping rods 580 and 590 extend in parallel to longitudinal axis 525 due to their fixed attachment to the moveable surface 508, which is now disposed in parallel with respect to the fixed surface 504.

It is noted that this second operative orientation of the movebale surface 508, as shown in FIG. 5B, is particularly operative for providing a shallow water swimming pool 502, which is safe for children or people that cannot swim.

Turning now specifically to FIG. 5C, the moveable surface 508 is disposed in its third operative orientation in FIG. 5C, which is the lowered inclined position of the moveable surface 508 relative to the fixed surface 504. It is seen in FIG. 5C that the force transfer mechanism 542 is further actuated and is now disposed in an extended position in this third operative orientation, in which the distance between the first end 554 of the plunger rod 552 and the first end 546 of the hydraulic cylinder 544 is larger than the distance thereof in FIG. 5B.

Upon further actuation of the force transfer mechanism 542, it is seen that the first and second structures 520 and 522 are further hingedly radially displaced with respect to the fixed surface 504 and now extend at an angle with respect to longitudinal axis 525, which is larger than the angle as illustrated in FIG. 5B. The first and second structures 520 and 522 are further moveable in parallel to each other in this third operative orientation due to the connecting rod 540 which is fixedly hingedly attached between the two structures 520 and 522.

It is a particular feature of an embodiment of the present invention that upon further actuation of the force transfer mechanism 542, one of the structures, in this case the second structure 522 disengages from the movable surface 508 and the moveable surface 508 is radially displaced downwardly relative to the fixed surface 504 up to engagement of the downward edge 594 of the second stopping rod 590 with the fixed surface 504. In this third operative orientation, the downward edges 592 and 594 of the stopping rods 580 and 590 respectively engage the fixed surface 504. Further radial displacement of the moveable surface 508 relative to the fixed surface 504 is restricted in this third operative orientation due to the second stopping rod 590 which is disposed between the moveable surface 508 and the fixed surface 504 and prevents further radial displacement of the moveable surface 508 relative to the fixed surface 504. It is particularly seen in FIG. 5C that the moveable surface 508 is disposed in an inclined position in this third operative orientation, in which the movable surface 508 is disposed at an angle relative to the fixed surface 504.

In this inclined position, one of the ends of the moveable surface 508 is disposed at a larger distance from the fixed surface 504 as compared to the other end of the moveable surface 508, thus assuming a lowered position of the moveable surface 508. In the lowered position, the moveable surface 508 is adapted to be lower than the upper surface of the swimming pool 502, acting as the floor of the swimming pool 502.

It is seen in FIG. 5C that the first and second stopping rods 580 and 590 are disposed at an angle relative to longitudinal axis 525 due to their fixed attachment to the moveable surface 508, which is now inclined relative to the fixed surface 504.

It is a particular feature of an embodiment of the present invention that the length of the first stopping rod 580 defines the depth of beginning of the radial displacement of the moveable surface 508 and the length of the second stopping rod 590 defines the depth of the incline, which is the deep end of the swimming pool 502.

It is seen that in this third operative orientation of the moveable surface 508 shown in FIG. 5C, the bearing 534 of the second structure 522 is disengaged from the moveable surface 508 and the bearing 534 of the first structure 520 is further slidably moveable along the downwardly facing surface 512 of the moveable surface 508.

It is a particular feature of an embodiment of the present invention that first and second structures 520 and 522 are supported between the fixed surface 504 and the moveable surface 508 and connecting rod 540 connects these two structures 520 and 522. The force transfer mechanism 542 is adapted for selectably applying force to one of the structures 520 and 522. Upon actuation of the force transfer mechanism 542, the first and second structures 520 and 522 are radially moveable in parallel to each other and hingedly with respect to the fixed surface 504, thus causing displacement of the moveable surface relative to the fixed surface 504. In a first mode of operation, the moveable surface 508 is displaced in parallel to the fixed surface 504 up to coupling of one side of the moveable surface 508 with the fixed surface 504 by means of a long stopping rod 580, upon such coupling, further axial displacement of the moveable surface 508 relative to the fixed surface 504 is prevented. In a second mode of operation, one of the structures 520 and 522 disengages the moveable surface 508 and the moveable surface 508 is radially displaced relative to the fixed surface 504 up to coupling of the other side of the moveable surface 508 with the fixed surface 504 by means of a short stopping rod 590, upon such coupling, further radial displacement of the moveable surface 508 relative to the fixed surface 504 is prevented.

It is noted that the elongated rods 524 and the connecting rod 540 are preferably made of durable materials that provide for a rigid structural moveable surface 508, which acts as the cover of the swimming pool 502.

It is additionally noted that tensile stress is applied onto the connecting rod 540, thus the connecting rod 540 acts as a link between the first structure 520 and the second structure 522. This provides for higher reliability, prevents a possibility of collapsing of the connecting rod 540 and allows decreasing the cross-sectional area thereof.

It is appreciated that FIGS. 5A-5C illustrate one particular mechanism for raising and lowering the moveable surface 508 relative to the fixed surface 504. Several alternative exemplary mechanisms are further described in FIGS. 2A-5C.

It will be appreciated by persons skilled in the art that the present invention is not limited by what has been particularly shown and described hereinabove. Rather the scope of the present invention includes both combinations and subcombinations of various features described hereinabove as well as variations and modifications thereof which are not in the prior art.

The invention claimed is:

1. A system for adjusting surface level, comprising:

a moveable surface;

a mechanism adapted to be disposed between and coupled to said moveable surface and a fixed surface, wherein said mechanism comprises a plurality of structures;

a force transfer mechanism configured to be coupled to said mechanism for displacement of said moveable surface relative to said fixed surface;

and at least one stopping rod, disposed between said moveable surface and said fixed surface, which is operative for restricting an axial movement of said moveable surface relative to said fixed surface in a first mode of operation and for restricting a radial movement of said moveable surface relative to said fixed surface in a second mode of operation, and wherein said at least one stopping rods does not engage said mechanism, and wherein in said second mode of operation at least one of said plurality of structures decouples from said moveable surface.

2. The system for adjusting surface level according to claim 1, and wherein said plurality of structures comprises a first and a second structures, which are supported between said fixed surface and said moveable surface and a connecting rod coupled between said first and second structures;

and wherein upon actuation of said force transfer mechanism, said first and second structures are radially moveable in parallel to each other, thus causing said axial displacement of said moveable surface relative to said fixed surface, whereas said moveable surface is displaced in parallel to said fixed surface up to coupling of one side of said moveable surface with said fixed surface by at least one of said plurality of stopping rods;

and wherein subsequently, said first and second structures are further radially moveable in parallel to each other, thus causing said radial displacement of said moveable surface relative to said fixed surface, whereas said moveable surface is displaced radially relative to said fixed surface up to coupling of another side of said moveable surface with said fixed surface by another one of said plurality of stopping rods.

3. The system for adjusting surface level according to claim 2, and wherein said first and second structures are adapted for slidable movement relative to said movable surface.

4. The system for adjusting surface level according to claim 2, and wherein each of said first and second structures are slidably coupled with said moveable surface and hingedly coupled with said fixed surface.

5. The system for adjusting surface level according to claim 4, and wherein said connecting rod is hingedly coupled to both of said first and second structures.

6. The system for adjusting surface level according to claim 2, and wherein said force transfer mechanism is a single force transfer mechanism employed in order to displace both said first structure and said second structure using said connecting rod, which provides for force transfer between said first and second structures.

7. The system for adjusting surface level according to claim 1, and wherein said force transfer mechanism comprises at least two force transfer mechanisms, supported between said fixed surface and said moveable surface;

and wherein upon actuation of said at least two force transfer mechanisms, said moveable surface is axially displaced relative to said fixed surface, whereas said moveable surface is displaced in parallel to said fixed surface up to coupling of one side of said moveable surface with said fixed surface by said at least one of said plurality of stopping rods;

and wherein subsequently, said moveable surface is radially displaced relative to said fixed surface, whereas said moveable surface is displaced radially relative to said fixed surface up to coupling of another side of said moveable surface with said fixed surface by another one of said plurality of stopping rods.

8. The system for adjusting surface level according to claim 1, and wherein said mechanism comprises first and second rods, which are supported between said fixed surface and said moveable surface and are hingedly attached to each other in a scissor-like manner;

and wherein upon actuation of said force transfer mechanism, said moveable surface is axially displaced relative to said fixed surface, whereas said moveable surface is displaced in parallel to said fixed surface up to coupling of one side of said moveable surface with said fixed surface by at least one of said plurality of stopping rods;

and wherein subsequently, said moveable surface is radially displaced relative to said fixed surface, whereas said moveable surface is displaced radially relative to said fixed surface up to coupling of another side of said moveable surface with said fixed surface by another one of said plurality of stopping rods.

9. The system for adjusting surface level according to claim 1, and wherein said at least one stopping rods comprises a first stopping rod having a first length and a second stopping rod having a second length and wherein said first length is greater than said second length and wherein said first stopping rod is operative for restricting said axial movement and said second stopping rod is operative for restricting said radial movement.

10. The system for adjusting surface level according to claim 1, and wherein said force transfer mechanism is a hydraulic cylinder.

11. The system for adjusting surface level according to claim 1, and wherein said moveable surface is adapted to fit an interior perimeter of a swimming pool.

12. The system for adjusting surface level according to claim 11, and wherein said force transfer mechanism is disposed within said swimming pool.

13. The system for adjusting surface level according to claim 1, and wherein said plurality of stopping rods are fixedly coupled to said moveable surface.

14. The system for adjusting surface level according to claim 1, and wherein transition between said first and second modes of operation results from engagement of at least one of said plurality of stopping rods with said fixed surface.

15. The system for adjusting surface level according to claim 1, and wherein said plurality of stopping rods are spaced apart from each other and extend in parallel to each other.

16. A method for adjusting surface level, comprising:

providing a moveable surface;

providing a mechanism adapted to be disposed between and coupled to said moveable surface and a fixed surface, wherein said mechanism comprises a plurality of structures;

coupling a force transfer mechanism to said mechanism for displacement of said moveable surface relative to said fixed surface;

providing at least one stopping rods, disposed between said moveable surface and said fixed surface, and wherein said at least one stopping rods does not engage said mechanism;

actuating said force transfer mechanism for axially moving said moveable surface relative to said fixed surface in a first mode of operation until restriction of said axial movement by said at least one of said plurality of stopping rods and thereafter radially moving said moveable surface relative to said fixed surface in a second mode of operation thereby causing at least one of said plurality of structures to decouple from said moveable surface, and thereby adjusting surface level of said moveable surface relative to said fixed surface.

17. The method for adjusting surface level according to claim 16 and wherein said plurality of structures comprises a first and a second structures supported between said fixed surface and said moveable surface and a connecting rod coupled between said first and second structures.

18. The method for adjusting surface level according to claim 16 and wherein said at least one stopping rods is fixedly coupled to said moveable surface.

* * * * *